US009475328B2

(12) United States Patent
Niederst et al.

(10) Patent No.: US 9,475,328 B2
(45) Date of Patent: Oct. 25, 2016

(54) DEVELOPER FOR THERMALLY RESPONSIVE RECORD MATERIALS

(71) Applicant: Valspar Sourcing, Inc., Minneapolis, MN (US)

(72) Inventors: Jeffrey Niederst, Leechburg, PA (US); Richard H. Evans, Wexford, PA (US); Robert M. O'Brien, Monongahela, PA (US); Kevin Romagnoli, Pittsburgh, PA (US); T. Howard Killilea, North Oaks, MN (US); Mark S. Von Maier, Harmony, PA (US); Lan Deng, Pittsburgh, PA (US)

(73) Assignee: Valspar Sourcing, Inc., Minneapolis, MN (US)

( * ) Notice: Subject to any disclaimer, the term of this patent is extended or adjusted under 35 U.S.C. 154(b) by 29 days.

(21) Appl. No.: 14/418,014

(22) PCT Filed: Mar. 15, 2013

(86) PCT No.: PCT/US2013/031979

§ 371 (c)(1),
(2) Date: Jan. 28, 2015

(87) PCT Pub. No.: WO2014/025400

PCT Pub. Date: Feb. 13, 2014

(65) Prior Publication Data

US 2015/0165805 A1 Jun. 18, 2015

Related U.S. Application Data

(60) Provisional application No. 61/681,608, filed on Aug. 9, 2012.

(51) Int. Cl.

| | |
|---|---|
| ***B41M 5/333*** | (2006.01) |
| ***G03G 9/12*** | (2006.01) |
| ***G03G 9/13*** | (2006.01) |

(52) U.S. Cl.

CPC ..... *B41M 5/3335* (2013.01); *G03G 9/12* (2013.01); *G03G 9/122* (2013.01); *G03G 9/132* (2013.01); *B41M 2205/04* (2013.01); *B41M 2205/24* (2013.01)

(58) Field of Classification Search

CPC . B41M 5/333; B41M 5/3333; B41M 5/3335
USPC ..... 503/216; 427/150, 151; 106/31.18
See application file for complete search history.

(56) References Cited

U.S. PATENT DOCUMENTS

| | | | |
|---|---|---|---|
| 3,085,992 | A | 4/1963 | Lee et al. |
| 3,153,008 | A | 10/1964 | Fox |
| 3,220,974 | A | 11/1965 | Fox |
| 3,275,601 | A | 9/1966 | Schnell et al. |
| 3,491,111 | A | 1/1970 | Lin |
| 3,491,112 | A | 1/1970 | Lin |
| 3,491,116 | A | 1/1970 | Lin |
| 3,509,174 | A | 4/1970 | Lin |
| 3,539,375 | A | 11/1970 | Baum |
| 3,624,107 | A | 11/1971 | Lin |
| 3,627,787 | A | 12/1971 | Lin |
| 3,641,011 | A | 2/1972 | Lin et al. |
| 3,642,828 | A | 2/1972 | Farber et al. |
| 3,681,390 | A | 8/1972 | Lin |
| 3,775,424 | A | 11/1973 | Farber |
| 3,853,869 | A | 12/1974 | Farber |
| 3,879,348 | A | 4/1975 | Serini et al. |
| 3,888,812 | A | 6/1975 | Plettner |
| 3,920,510 | A | 11/1975 | Hatano et al. |
| 3,959,571 | A | 5/1976 | Yahagi et al. |
| RE28,862 | E | 6/1976 | Siemonsen et al. |
| 3,971,808 | A | 7/1976 | Baumann et al. |
| 4,011,184 | A | 3/1977 | van Reijendam et al. |
| 4,076,764 | A | 2/1978 | Bauer |
| 4,111,910 | A | 9/1978 | Baggett |
| 4,172,103 | A | 10/1979 | Serini et al. |
| 4,333,809 | A | 6/1982 | Schreckenberg et al. |
| 4,368,315 | A | 1/1983 | Sikdar |
| 4,374,233 | A | 2/1983 | Loucks et al. |
| 4,468,483 | A | 8/1984 | Yeakey et al. |
| 4,510,513 | A | 4/1985 | Yamaguchi et al. |
| 4,522,984 | A | 6/1985 | Watanabe et al. |
| 4,564,655 | A | 1/1986 | Liu |
| 4,611,036 | A | 9/1986 | Sekiguchi et al. |
| 4,657,941 | A | 4/1987 | Blackwell et al. |
| 4,696,955 | A | 9/1987 | Kuhlmann |

(Continued)

FOREIGN PATENT DOCUMENTS

| | | | |
|---|---|---|---|
| EP | 0 265 791 | A2 | 5/1988 |
| EP | 0 313 862 | A2 | 5/1989 |
| EP | 0185118 | B1 | 9/1995 |
| JP | H07-126574 | A | 5/1995 |
| JP | 08-230328 | | 9/1996 |
| JP | 2002-097250 | A | 4/2002 |
| JP | 2002-138245 | A | 5/2002 |
| JP | 2003-176348 | A | 6/2003 |
| JP | 3 484546 | B2 | 1/2004 |
| JP | 2004-10874 | A | 1/2004 |

(Continued)

OTHER PUBLICATIONS

Fang, H. et al., "Structure-Activity Relationships for a Large Diverse Set of Natural, Synthetic, and Environmental Estrogens." Chem. Res. Toxicol, vol. 14, No. 3, pp. 280-294 (2001).

(Continued)

*Primary Examiner* — Bruce H Hess
(74) *Attorney, Agent, or Firm* — IPLM Group, P.A.

(57) ABSTRACT

A thermally responsive composition includes a dye and a developer that is free of polyhydric phenols having estrogenic agonist activity greater than or equal to that of bisphenol S. The thermally responsive composition can be used to make BPA-free thermally responsive record materials.

17 Claims, No Drawings

(56) References Cited

U.S. PATENT DOCUMENTS

| | | | | |
|---|---|---|---|---|
| 4,729,983 | A | 3/1988 | Satake et al. | |
| 4,794,102 | A | 12/1988 | Petersen et al. | |
| 4,794,156 | A | 12/1988 | Ho et al. | |
| 4,816,495 | A | 3/1989 | Blackwell et al. | |
| 4,849,502 | A | 7/1989 | Evans et al. | |
| 4,994,217 | A | 2/1991 | Banevicius et al. | |
| 5,010,147 | A | 4/1991 | Westeppe et al. | |
| 5,032,567 | A * | 7/1991 | Ohtsubo | B41M 5/3375 427/150 |
| 5,068,284 | A | 11/1991 | Ullman et al. | |
| 5,080,961 | A | 1/1992 | Macy et al. | |
| 5,102,608 | A | 4/1992 | Frencken et al. | |
| 5,288,839 | A | 2/1994 | Greco | |
| 5,318,999 | A | 6/1994 | Mitra et al. | |
| 5,446,009 | A | 8/1995 | Minami et al. | |
| 5,494,950 | A | 2/1996 | Asakage et al. | |
| 5,496,921 | A | 3/1996 | Sakashita et al. | |
| 5,576,413 | A | 11/1996 | Bussink et al. | |
| 5,591,788 | A | 1/1997 | Anderson et al. | |
| 5,803,301 | A | 9/1998 | Sato et al. | |
| 5,807,912 | A | 9/1998 | Wu et al. | |
| 5,859,172 | A | 1/1999 | Sakashita et al. | |
| 5,876,210 | A | 3/1999 | Klee et al. | |
| 5,880,248 | A | 3/1999 | Sakashita et al. | |
| 6,043,333 | A | 3/2000 | Kuboki et al. | |
| 6,048,931 | A | 4/2000 | Fujita et al. | |
| 6,060,577 | A | 5/2000 | Davis | |
| 6,103,311 | A | 8/2000 | Masuda et al. | |
| 6,133,402 | A | 10/2000 | Coates et al. | |
| 6,184,339 | B1 | 2/2001 | Stansbury et al. | |
| 6,225,436 | B1 | 5/2001 | Eiffler et al. | |
| 6,399,738 | B1 | 6/2002 | Ito | |
| 6,469,127 | B1 | 10/2002 | Furunaga et al. | |
| 6,566,426 | B1 | 5/2003 | Kanaida et al. | |
| 6,579,829 | B2 | 6/2003 | Nishimura et al. | |
| 6,608,163 | B2 | 8/2003 | Bailly et al. | |
| 6,660,688 | B2 | 12/2003 | Yamada et al. | |
| 6,723,765 | B2 | 4/2004 | Bammel | |
| 6,833,398 | B2 | 12/2004 | Agarwal et al. | |
| 6,844,071 | B1 | 1/2005 | Wang et al. | |
| 6,916,874 | B2 | 7/2005 | Mazza et al. | |
| 6,924,328 | B2 | 8/2005 | Legleiter et al. | |
| 6,984,262 | B2 | 1/2006 | King et al. | |
| 6,984,608 | B2 | 1/2006 | Makitalo et al. | |
| 7,022,765 | B2 | 4/2006 | Adedeji et al. | |
| 7,087,705 | B2 | 8/2006 | Ashtekar et al. | |
| 7,141,359 | B2 | 11/2006 | Suga et al. | |
| 7,256,228 | B2 | 8/2007 | Agarwal et al. | |
| 7,332,560 | B2 | 2/2008 | Heuer et al. | |
| 7,635,662 | B2 | 12/2009 | Kabashima et al. | |
| 7,682,674 | B2 | 3/2010 | Vogt et al. | |
| 7,803,439 | B2 | 9/2010 | Crawford et al. | |
| 7,803,440 | B2 | 9/2010 | Crawford et al. | |
| 8,124,669 | B2 | 2/2012 | Terakawa et al. | |
| 8,142,858 | B2 | 3/2012 | Cooke et al. | |
| 8,353,657 | B2 | 1/2013 | Lat et al. | |
| 8,795,830 | B2 | 8/2014 | Wyman et al. | |
| 8,906,507 | B2 | 12/2014 | Campbell et al. | |
| 9,096,772 | B2 | 8/2015 | Lespinasse et al. | |
| 9,168,206 | B2 | 10/2015 | Wang et al. | |
| 2003/0181628 | A1 | 9/2003 | Horn et al. | |
| 2003/0203991 | A1 | 10/2003 | Schottman et al. | |
| 2003/0209553 | A1 | 11/2003 | Horn et al. | |
| 2004/0044101 | A1 | 3/2004 | Hirose et al. | |
| 2004/0176563 | A1 | 9/2004 | Shinohara et al. | |
| 2004/0220372 | A1 | 11/2004 | Qi et al. | |
| 2004/0242723 | A1 | 12/2004 | Jin et al. | |
| 2005/0014004 | A1 | 1/2005 | King et al. | |
| 2005/0090593 | A1 | 4/2005 | Heuer et al. | |
| 2005/0118526 | A1 | 6/2005 | Suga et al. | |
| 2006/0025559 | A1 | 2/2006 | Wehrmann et al. | |
| 2006/0052523 | A1 | 3/2006 | Bushendorf et al. | |
| 2006/0134541 | A1 | 6/2006 | Fujii et al. | |
| 2007/0036903 | A1 | 2/2007 | Mayr et al. | |
| 2007/0087146 | A1 | 4/2007 | Evans et al. | |
| 2007/0099130 | A1 | 5/2007 | Takahashi et al. | |
| 2008/0246173 | A1 | 10/2008 | Braidwood et al. | |
| 2008/0314500 | A1 | 12/2008 | Boers et al. | |
| 2008/0319156 | A1 | 12/2008 | Fischer et al. | |
| 2009/0326107 | A1 | 12/2009 | Bittner | |
| 2010/0056721 | A1 | 3/2010 | Wright et al. | |
| 2010/0086716 | A1 | 4/2010 | Rüdiger et al. | |
| 2011/0003267 | A1 | 1/2011 | Terakawa et al. | |
| 2011/0042338 | A1 | 2/2011 | Pecorini et al. | |
| 2011/0160408 | A1 | 6/2011 | de Brouwer et al. | |
| 2011/0275035 | A1 | 11/2011 | Lu | |
| 2011/0315591 | A1 | 12/2011 | Lespinasse et al. | |
| 2012/0125800 | A1 | 5/2012 | Doreau et al. | |
| 2012/0172568 | A1 | 7/2012 | Ueda | |
| 2012/0276315 | A1 | 11/2012 | Michel et al. | |
| 2012/0276503 | A1 | 11/2012 | Wang et al. | |
| 2013/0206756 | A1 | 8/2013 | Niederst | |
| 2013/0280455 | A1 | 10/2013 | Evans et al. | |
| 2013/0316109 | A1 | 11/2013 | Niederst et al. | |
| 2014/0113093 | A1 | 4/2014 | Corbin et al. | |

FOREIGN PATENT DOCUMENTS

| | | |
|---|---|---|
| WO | WO 95/26997 | 10/1995 |
| WO | WO 97/28905 | 8/1997 |
| WO | WO 98/50477 | 11/1998 |
| WO | WO 00/71337 A1 | 11/2000 |
| WO | WO 2007/048094 A2 | 4/2007 |
| WO | WO 2008/137562 A1 | 11/2008 |
| WO | WO 2009/015493 A1 | 2/2009 |
| WO | WO 2010/118349 A1 | 10/2010 |
| WO | WO 2010/118356 A1 | 10/2010 |
| WO | WO 2011/130671 A2 | 10/2011 |
| WO | WO 2012/109278 A2 | 8/2012 |
| WO | WO 2014/140233 A1 | 9/2014 |
| WO | WO 2014/140234 A1 | 9/2014 |

OTHER PUBLICATIONS

Meti, "Current Status of Testing Methods Development for Endocrine Distrupters." 6th Meeting of the Task Force on Edocrine Distrupters Testing and Assessment (EDTA), Tokyo, Ministry of Economy, Trade and Industry, Japan, 70 pages (Jun. 24-25, 2002).

Kitamura, S., et al., "Comparative Study of the Endocrine-Disrupting Activity of Bisphenol A and 19 Related Compounds," Toxicological Sciences, vol. 84, 249-259, doi:10.1093/toxcie/kfi074, Advance Access publication, 11 pages (Jan. 5, 2005).

Liu Z., et al., "Preparation, characterization and thermal properties of tetramethylbisphenol F exposy resin and mixed systems," Polym Int 2012; 61: 565-570, © 2011 Society of Chemical Industry, published online in Wiley Online Library: 6 pages (Nov. 10, 2011).

Fang H., et al., "Quantitative Comparisons of in Vitro Assays for Estrogenic Activities," Environmental Health Perspectives, vol. 108, No. 8, pp. 723-729, 7 pages (Aug. 2000).

"Test Method Nomination: MCF-7 Cell Proliferation Assay of Estrogenic Activity" submitted for validation by CertiChem, Inc. to the National Toxicology Program Interagency Center for the Evaluation of Alternative Toxicological Methods (NICEATM) on Jan. 19, 2006 (102 pages, available online at ntp.niehs.nih.gov/iccvam/methods/endocrine/endodocs/submdoc.pdf).

Matasa, C., et al., "A wish list for orthodontic materials, 2005" The Orthodontic Materials Insider, vol. 16 Nr. 4, 8 pages (Dec. 2004).

Moss, G.P., "Extension and Revision of the Von Baeyer System for Naming Polycyclic Compounds (Including Bycyclic Compounds)", IUPAC Recommendations 1999, Pure Appl. Chem., vol. 71, No. 3, pp. 513-529, 17 pages (1999).

Song, K., et al., :Endocrine Disrupter Bisphenol A Induces Orphan Nuclear Receptor Nur77 Gene Expression and Steroidogenesis in Mouse Testicular Leydig Cells, Endocrinology 143(6):2208-2215, Copyright 2002 by The Endocrine Society, 8 pages.

(56) References Cited

OTHER PUBLICATIONS

Kobayashi, S. et al., "Stereo Structure-Controlled and Electronic Structure-Controlled Estrogen-Like Chemicals to Design and Develop Non-estrogenic Bisphenol A Analogs Based on Chemical Hardness Concept," Chem. Pharm. Bull. 54(12):1633-1638, 2006 Pharmaceutical Society of Japan, 6 pages (Dec. 2006).
"Flame Retardant Bisphenol F", Product Information Sheets, Nippon Kasei Chemical, 2 pages (2013).
Eastman, "Eastman TritanTM Copolyester—Lack of estrogen and testosterone activity," TRS-270, 3 pages (Apr. 2010).
Viñas, P. et al, "Comparison of two derivatization-based methods for solid-phase microextraction-gas chromotography-mass spectrometric determination of bisphenol A, bisphenol S. and bisphenol migarted from food cans," published online Feb. 3, 2010, Springer-Verlag, 11 pages (2010).
Dytek® A-Amine (2014) downloaded from the Oct. 16, 2014 Internet Archives capture at https://web.archive.org/web/20141016043145/http://dytek.invista.com/Products/Amines/dytek-a-amine.
Tice, R.R. "The single cell gel/comet assay: a microgel electrophoretic technique for the detection of DNA damage and repair in individual cells." Environmental Mutagenesis, Eds. Phillips, D.H and Venitt, S. Bios Scientific, Oxford, UD, pp. 315-339 (1995).
Woo, B. et al., Melt Polycondensation of Bisphenol A Polycarbonate by a Forced Gas Sweeping Process, Ind. Eng. Chem. Res., vol. 40, No. 5, pp. 1312-1319 (2001).
Polycarbonates, $4^{th}$-$5^{th}$ Edition, Kirk-Othmer Encyclopedia of Chemical Technology, pp. 1-30 (2000).
Porter, D. S. et al., Hot-Fill Containers, New Tech for OPP & PET, Plastics Technology, Eastman Chemical Co., 6 pages (Dec. 2007).
Grace Darex® Packaging Technologies, A Global Partner for your global business, Product Book, 4 pages (2006).
Mendum, T. et al., "Research Letter, Concentration of bisphenol A in thermal paper", Green Chemistry Letters and Reviews, vol. 4, No. 1, pp. 81-86 (Mar. 2011).
Matsumoto, S. et al., "The crystal structure of two new developers for high-performance thermo-sensitive paper: H-bonded network in urea-urethane derivatives", Dyes and Pigments, 85, pp. 139-142 (2010).

* cited by examiner

DEVELOPER FOR THERMALLY RESPONSIVE RECORD MATERIALS

CROSS REFERENCE TO RELATED APPLICATIONS

This application is a national stage filing under 35 U.S.C. §371 of International Application No. PCT/US2013/031979 filed Mar. 15, 2013, which claims priority under 35 U.S.C. §119 to U.S. Provisional Application No. 61/681,608 filed Aug. 9, 2012, the disclosures of both of which are incorporated herein by reference.

FIELD

This invention relates to thermally responsive compositions and thermally responsive record materials.

BACKGROUND

Bisphenol A (BPA) is used in some thermally sensitive paper products such as cash-register receipts, shipping labels and lottery tickets. Thermal paper typically includes a base sheet and a thermally responsive coating with color forming chemicals that when heated produce color. BPA is often used as a color developer in the thermally responsive coating.

SUMMARY

Disclosed are alternatives to BPA-derived developers, in particular developers with reduced or no estrogenic activity that are useful in preparing thermally responsive record materials.

The present invention provides, in one aspect, a thermally responsive composition, comprising a dye and a developer, the developer comprising (i) a polyhydric phenol having one or more aryl or heteroaryl groups in which each aryl or heteroaryl group includes a hydroxyl group attached to the ring and a substituent group (a "bulky" substituent group) attached to the ring at an ortho or meta position relative to the hydroxyl group, (ii) a polyhydric phenol having two or more aryl or heteroaryl groups joined by a polar linking group or by a linking group having a molecular weight of at least 125 Daltons, (iii) a polyhydric phenol having the features of both (i) and (ii); and wherein the composition is free of polyhydric phenols having estrogenic activity greater than or equal to bisphenol S.

The present invention provides, in another aspect, a thermally responsive composition comprising a dye and a developer the developer comprising a polyhydric phenol shown in Formula I:

Formula (I)

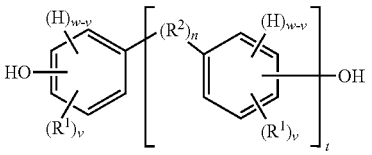

wherein:

H denotes a hydrogen atom, if present;

each $R^1$ is independently an atom or group having an atomic weight of at least 15 Daltons;

each v is independently 0 to 4; preferably 1 to 4; with the proviso that if v is 0, then n is 1 or the phenylene groups depicted in Formula I join to form a fused ring system;

w is 4;

$R^2$, if present, is a divalent group;

n is 0 or 1; with the proviso that if n is 0, the phenylene groups depicted in Formula I can optionally join to form a fused ring system in which case w is 3 and v is 0 to 3;

t is 0 or 1;

if v is 0 and t is 1, $R^2$ is a polar linking group or a linking group having a molecular weight of at least 125 Daltons;

two or more $R^1$ or $R^2$ groups can join to form one or more cyclic groups; and the composition is preferably substantially free of polyhydric phenols having estrogenic agonist activity greater than or equal to that of bisphenol S.

The present invention provides, in another aspect, a method for providing a thermally responsive record material comprising:

(a) providing a substrate;

(b) applying a thermally responsive composition onto the substrate;

wherein the thermally responsive composition comprises a dye and a developer, the developer comprising the compound shown in Formula (I).

DEFINITIONS

As used herein, "a," "an," "the," "at least one," and "one or more" are used interchangeably. Thus, for example, a composition that includes "a" developer can include "one or more" developers.

The term "aryl group" (e.g., an arylene group) refers to a closed aromatic ring or ring system such as phenylene, naphthylene, biphenylene, fluorenylene, and indenyl, as well as heteroarylene groups (e.g., a closed aromatic or aromatic-like ring hydrocarbon or ring system in which one or more of the atoms in the ring is an element other than carbon, for example nitrogen, oxygen, sulfur, and the like). Suitable heteroaryl groups include furyl, thienyl, pyridyl, quinolinyl, isoquinolinyl, indolyl, isoindolyl, triazolyl, pyrrolyl, tetrazolyl, imidazolyl, pyrazolyl, oxazolyl, thiazolyl, benzofuranyl, benzothiophenyl, carbazolyl, benzoxazolyl, pyrimidinyl, benzimidazolyl, quinoxalinyl, benzothiazolyl, naphthyridinyl, isoxazolyl, isothiazolyl, purinyl, quinazolinyl, pyrazinyl, 1-oxidopyridyl, pyridazinyl, triazinyl, tetrazinyl, oxadiazolyl, thiadiazolyl, and so on. When such groups are divalent, they are typically referred to as "arylene" or "heteroarylene" groups (e.g., furylene, pyridylene, and the like).

The term "BPA" refers to bisphenol A (also known as 4,4'-(propane-2,2-diyl)diphenol; p,p'-isopropylidenebisphenol or 2,2-bis(4-hydroxyphenyl)propane), and the term "BPS" refers to bisphenol S (also known as 4,4'-sulfonylbisphenol or bis(4-hydroxyphenyl)sulfone).

The term "comprises" and variations thereof do not have a limiting meaning where these terms appear in the description and claims.

The terms "estrogenic activity" or "estrogenic agonist activity" refer to the ability of a compound to mimic hormone-like activity through interaction with an endogenous estrogen receptor, typically an endogenous human estrogen receptor.

A group that may be the same or different is referred to as being "independently" something.

The term "mobile" when used with respect to a thermally responsive record material means that the compound can be extracted from the composition or a dried layer of the composition on a substrate (typically ~1 mg/cm$^2$) is exposed to a test medium for some defined set of conditions, depending on the end use. An example of these testing conditions is exposure of the coating to HPLC-grade acetonitrile for 24 hours at 25° C. The term "on," when used in the context of a coating applied on a surface or substrate, includes both coatings applied directly or indirectly to the surface or substrate. Thus, for example, a coating applied to a primer layer overlying a substrate constitutes a coating applied on the substrate.

As used herein, the term "organic group" means a hydrocarbon group (with optional elements other than carbon and hydrogen, such as oxygen, nitrogen, sulfur, and silicon) that is classified as an aliphatic group, a cyclic group, or combination of aliphatic and cyclic groups (e.g., alkaryl and aralkyl groups). The term "cyclic group" means a closed ring hydrocarbon group that is classified as an alicyclic group or an aromatic group, both of which can include heteroatoms. The term "alicyclic group" means a cyclic hydrocarbon group having properties resembling those of aliphatic groups.

The term "phenylene" as used herein refers to a six-carbon atom aryl ring (e.g., as in a benzene group) that can have any substituent groups (including, e.g., halogen atoms, hydrocarbon groups, hydroxyl groups, hydroxyl groups, and the like). Thus, for example, the following aryl groups are each phenylene rings: —$C_6H_4$—, —$C_6H_3(CH_3)$—, and —$C_6H(CH_3)_2Cl$—. In addition, for example, each of the aryl rings of a naphthalene group is a phenylene ring.

The term "polyhydric phenol" as used herein refers broadly to any compound having one or more aryl or heteroaryl groups (more typically one or more phenylene groups) and at least two hydroxyl groups attached to a same or different aryl or heteroaryl ring. Thus, for example, both hydroquinone and 4,4'-biphenol are considered to be polyhydric phenols. As used herein, polyhydric phenols typically have six carbon atoms in an aryl ring, although it is contemplated that aryl or heteroaryl groups having rings of other sizes may be used.

The terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

The term "sheet(s)" denote articles having two large surface dimensions and a comparatively small thickness dimension.

The term "substantially contiguous relationship" when used in respect to the thermally responsive components is understood to mean that the components are positioned in sufficient proximity to one another such that upon melting, softening or subliming one or more of the color-forming components (e.g. dye or developer) the components in the thermally responsive composition contact each other to result in a color reaction.

The term "substantially free" when used with respect to a thermally responsive record material that may contain a particular mobile compound means that the thermally responsive record material contains less than 1,000 parts per million (ppm) of the recited mobile compound. The term "essentially free" when used with respect to a thermally responsive record material that may contain a particular mobile compound means that the thermally responsive record material contains less than 100 parts per million (ppm) of the recited mobile compound. The term "essentially completely free" when used with respect to a thermally responsive record material that may contain a particular mobile compound means that the thermally responsive record material contains less than 5 parts per million (ppm) of the recited mobile compound. The term "completely free" when used with respect to a thermally responsive record material that may contain a particular mobile compound means that the thermally responsive record material contains less than 20 parts per billion (ppb) of the recited mobile compound. If the aforementioned phrases are used without the term "mobile" (e.g., "substantially free of BPA") then the recited developer or composition contains less than the aforementioned amount of the compound whether the compound is mobile in the coating or bound to a constituent of the coating.

The disclosed organic groups of the compounds may be substituted. As a means of simplifying the discussion and recitation of certain terminology used throughout this application, the terms "group" and "moiety" are used to differentiate between chemical species that allow for substitution or that may be substituted and those that do not allow or may not be so substituted. Thus, when the term "group" is used to describe a chemical substituent, the described chemical material includes the unsubstituted group and that group with O, N, Si, or S atoms, for example, in the chain (as in an alkoxy group) as well as carbonyl groups or other conventional substituents. Where the term "moiety" is used to describe a chemical compound or substituent, only an unsubstituted chemical material is intended to be included. For example, the phrase "alkyl group" is intended to include not only pure open chain saturated hydrocarbon alkyl substituents, such as methyl, ethyl, propyl, t-butyl, and the like, but also alkyl substituents bearing further substituents known in the art, such as hydroxy, alkoxy, alkylsulfonyl, halogen atoms, cyano, nitro, amino, carboxyl, and the like. Thus, "alkyl group" includes ether groups, haloalkyl, nitroalkyl, carboxyalkyl, hydroxyalkyl, sulfoalkyl, and the like. On the other hand, the phrase "alkyl moiety" is limited to the inclusion of only pure open chain saturated hydrocarbon alkyl substituents, such as methyl, ethyl, propyl, t-butyl, and the like. As used herein, the term "group" is intended to be a recitation of both the particular moiety, as well as a recitation of the broader class of substituted and unsubstituted structures that includes the moiety.

Also herein, the recitations of numerical ranges by endpoints include all numbers subsumed within that range (e.g., 1 to 5 includes 1, 1.5, 2, 2.75, 3, 3.80, 4, 5, and the like). Furthermore, disclosure of a range includes disclosure of all subranges included within the broader range (e.g., 1 to 5 discloses 1 to 4, 1.5 to 4.5, 4 to 5, and the like).

DETAILED DESCRIPTION

Typically, a thermally responsive record material includes a substrate or support which has applied on it a thermally responsive coating composition. The thermally responsive composition typically includes a color former (dye) and a color developer. The color developer is typically a weak acid that donates a proton to the dye resulting in color change.

The coating is capable of forming or changing color when heat is applied, for example, through a thermal print head resulting in an image.

Exemplary color formers or dyes are electron-donating dye precursors such as chromogenic materials including phthalide, leucauramine and fluoran compounds. Other exemplary dyes include Crystal Violet Lactone (3,3-bis(4-dimethylaminophenyl)-6-dimethylaminophthalide, (e.g. U.S. Pat. No. RE 23,024); phenyl-, indol-, pyrrol-, and carbazol-substituted phthalides (e.g., U.S. Pat. Nos. 3,491,111; 3,491,112; 3,491,116 and 3,509,174); nitro-, amino-, amido-, sulfon amido-, aminobenzylidene-, halo- and anilino-substituted fluorans (e.g., U.S. Pat. Nos. 3,624,107; 3,627,787; 3,641,011; 3,642,828 and 3,681,390); spirodipyrans (e.g. U.S. Pat. No. 3,971,808); and pyridine and pyrazine compounds (e.g., U.S. Pat. Nos. 3,775,424 and 3,853,869). Other exemplary dyes include 3-diethylamino-6-methyl-7-anilino-flouran (e.g., U.S. Pat. No. 4,510,513) also known as 3-dibutylamino-6-methyl-7-anilino-fluoran; 3-dibutylamino-7-(2-chloroanilino) fluoran; 3-(N-ethyl-N-tetrahydrofurfurylamino)-6-methyl-7-3,5'6-tris(dimethylamino)spiro[9H-fluorene-9,1'(3'H)-isobenzofuran]-3'-one; 7-(1-ethyl-2-methylindol-3-yl)-7-(2-chloroanilino) fluoran (U.S. Pat. No. 3,920,510); 3-(N-methylcyclohexylamino)-6-methyl-7-anilinofluoran (U.S. Pat. No. 3,959,571); 7-(1-octyl-2-methylindol-3-yl)-7-(4-diethylamino-2-ethoxyphenyl)-5,7-dihydrofuro[3,4-b]pyridin-5-one; 3-diethylamino-7,8-benzofluoran; 3,3-bis(1-ethyl-2-methylindol-3-yl) phthalide; 3-diethylamino-7-anilinofluoran; 3-diethylamino-7-benzylaminofluoran; 3'-phenyl-7-dibenzylamino-2,2'-spirodi-[2-H-1-benzopyran] and mixtures of any of the above.

The color former may be selected to provide a variety of developed colors, with black, blue and red colors being preferred. Selection of such color formers will be familiar to persons having ordinary skill in the thermally responsive record material art. For example, black color formers include 3-(dibutylamino)-6-methyl-7-anilinofluoran; 3-(dibutylamino)-7-(2-chlorophenylamino)fluoran; 3-(diethylamino)-6-chloro-7-anilinofluoran; 3(diethylamino)-6-methyl-7-(2,4-dimethylphenylamino)fluoran; 3-(diethylamino)-6-methyl-7-(3-methylphenylamino)fluoran; (ODB-7) 3-(diethylamino)-6-methyl-7-anilinofluoran; 3-(diethylamino)-7-(3-trifluoromethylphenylamino)fluoran; 3-(dipentylamino)-6-methyl-7-anilinofluoran; 3-(N-ethyl-N-isobutylamino)-6-methyl-7-anilinofluoran; 3-(N-ethyl-N-isopentylamino)-6-methyl-7-anilinofluoran; (S 205) 3-(N-ethyl-N-isopentylamino)-7-(2-chlorophenylamino)fluoran; 3-(N-ethyl-N-p-tolylamino)-6-methyl-7-anilinofluoran; 3-(N-methyl-N-cyclohexylamino)-6-methyl-7-anilinofluoran; 3-(N-methyl-N-propylamino)-6-methyl-7-anilinofluoran; 3-(N-tetrahydrofurfuryl-N-ethylamino)-6-methyl-7-anilinofluoran; 3-[N-ethyl N-(3-ethoxypropyl)amino]-6-methyl-7-anilinofluoran, and the like, and mixtures thereof.

The disclosed developer is preferably a polyhydric phenol having one or more aryl or heteroaryl groups in which each aryl or heteroaryl group includes a hydroxyl group attached to the ring and preferably an optional substituent group attached to the ring at an ortho or meta position relative to the hydroxyl group and wherein the composition is free of polyhydric phenols having estrogenic activity greater than or equal to bisphenol S.

As depicted in the above Formula (I), the polyhydric phenol includes a pair of phenylene groups and may optionally include one or more additional phenylene or other aryl or heteroaryl groups. Although aryl groups having a six-carbon aromatic ring are presently preferred, it is contemplated that any other suitable aryl or heteroaryl groups may be used in place of the phenylene groups depicted in Formula (I). As depicted in the above Formula (I), the substituent groups (e.g., —OH, H, $R^1$, and $R^2$) of each phenylene group can be located at any position on the ring relative to one another, although in preferred embodiments at least one $R^1$ is positioned on the ring immediately adjacent to the hydroxyl group. In other embodiments in which other aryl or heteroarylene groups are used in place of the depicted phenylene groups in Formula (I), it is contemplated that the same would hold true for the substituent groups of such other aryl or heteroarylene groups.

When t is 1, the compound of Formula (I) is of the below Formula (IA) with v, w, $R^1$, $R^2$ and n as previously described:

Formula (IA)

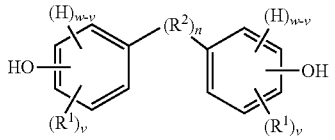

When t is 0, the compound of Formula (I) is of the below Formula (IB):

Formula (IB)

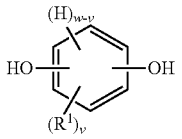

Examples of polyhydric monophenol compounds of Formula (IB) include catechol and substituted catechols (e.g., 3-methylcatechol, 4-methylcatechol, 4-tert-butyl catechol, and the like); hydroquinone and substituted hydroquinones (e.g., methylhydroquinone, 2,5-dimethylhydroquinone, trimethylhydroquinone, tetramethylhydroquinone, ethylhydroquinone, 2,5-diethylhydroquinone, triethylhydroquinone, tetraethylhydroquinone, tert-butylhydroquionine, 2,5-di-tert-butylhydroquinone, and the like); resorcinol and substituted resorcinols (e.g., 2-methylresorcinol, 4-methyl resorcinol, 2,5-dimethylresorcinol, 4-ethylresorcinol, 4-butylresorcinol, 4,6-di-tert-butylresorcinol, 2,4,6-tri-tert-butylresorcinol, and the like); and variants and mixtures thereof.

The ingredients used to make the coating composition are preferably free of any polyhydric phenols, that exhibit an estrogenic agonist activity in the MCF-7 assay (discussed below) greater than or equal to that that exhibited by 4,4'-(propane-2,2-diyl)diphenol in the assay. More preferably, the aforementioned ingredients are free of any polyhydric phenols that exhibit an estrogenic agonist activity in the MCF-7 assay greater than or equal to that of bisphenol S. Even more preferably, the aforementioned ingredients are free of any polyhydric phenols that exhibit an estrogenic agonist activity in the MCF-7 assay greater than that of 4,4'-(propane-2,2-diyl)bis(2,6-dibromophenol). Optimally, the aforementioned ingredients are free of any polyhydric phenols that exhibit an estrogenic agonist activity in the MCF-7 assay greater than about that of 2,2-bis(4-hydroxyphenyl)propanoic acid.

While not intending to be bound by theory, it is believed that a polyhydric phenol is less likely to exhibit any appreciable estrogenic agonist activity if the compound's chemical structure is sufficiently different from compounds having estrogenic activity such as diethylstilbestrol. The structure of preferred polyhydric phenol compounds, as will be discussed herein, is sufficiently different such that the compounds do not bind and activate a human receptor. These preferred compounds are, in some instances, at least about 6 or more orders of magnitude less active than diethylstilbestrol (e.g., when assessing estrogenic agonist effect using an in vitro assay such as the MCF-7 cell proliferation assay discussed below). Without being bound by theory, it is believed that such desirable structural dissimilarity can be introduced via one or more structural features, including any suitable combination thereof. For example, it is believed that one or more of the following structural characteristics can be used to achieve such structural dissimilarity:

- steric hinderance (e.g., relative to one or more hydroxyl phenols),
- molecular weight that is arranged in three-dimensional space such that: (i) the compound does not fit, or does not readily fit, in the active site of a human estrogen receptor or (ii) the structural configuration interferes with activation of the human estrogen receptor once inside the active site, and
- the presence of polar groups (e.g., in addition to the two hydroxyl groups of a bisphenol compound).

In preferred embodiments, $R^1$ in Formula (I) is preferably located at an ortho position on the ring relative to the oxygen atom. In some embodiments, an $R^1$ is located at each ortho position on the ring relative to the oxygen atom. While not intending to be bound by theory, it is believed that the positioning of one or more $R^1$ groups at an ortho position relative to the oxygen atom depicted in Formula (I) may be beneficial in reducing or eliminating estrogenic agonist activity.

In another embodiment, the one or more hydroxyl groups present on each aryl ring of a polyhydric phenol compound (typically phenol hydroxyl groups of a bisphenol) are sterically hindered by one or more other substituents of the aryl ring, as compared to a similar polyhydric phenol compound having hydrogen atoms present at each ortho or meta position. It is believed that it may be preferable to have substituent groups positioned at each ortho position relative to the aforementioned hydroxyl groups to provide optimal steric effect. It is believed that the steric hindrance can prevent or limit the ability of a polyhydric phenol compound to act as an agonist for a human estrogen receptor.

Preferred $R^1$ groups are sufficiently "bulky" to provide a suitable level of steric hindrance for the aforementioned hydroxyl groups to achieve the desired effect. To avoid any ambiguity, the term "group" when used in the context of $R^1$ groups refers to both single atoms (e.g., a halogen atom) or molecules (e.g., two or more atoms). The optimal chemical constituents, size, or configuration (e.g., linear, branched, etc.) of the one or more $R^1$ groups may depend on a variety of factors, including, for example, the location of the $R^1$ group on the aryl ring.

Certain preferred compounds of Formula (I) include up to four $R^1$ groups having an atomic weight of at least 15 Daltons. In some embodiments, the compounds of Formula (I) include up to four $R^1$ groups having an atomic weight of at least 25, at least 40, or at least 50 Daltons. While the maximum suitable size of is not particularly limited, typically it will be less than 500 Daltons, more typically less than 100 Daltons, and even more typically less than 60 Daltons. Non-limiting examples of $R^1$ groups include groups having at least one carbon atom (e.g., organic groups), halogen atoms, or sulfur-containing groups.

In presently preferred embodiments, the $R^1$ groups of each phenylene group, if present, preferably include at least one carbon atom, more preferably 1 to 10 carbon atoms, and even more preferably 1 to 4 carbon atoms. $R^1$ will typically be a saturated or unsaturated hydrocarbon group, more typically saturated, that may optionally include one or more heteroatoms other than carbon or hydrogen atoms (e.g., N, O, S, Si, a halogen atom, etc.). Examples of suitable hydrocarbon groups may include substituted or unsubstituted groups including alkyl groups (e.g., methyl, ethyl, propyl, butyl, etc., including isomers thereof), alkenyl groups, alkynyl groups, alicyclic groups, aryl groups, or combinations thereof.

In certain preferred embodiments, each phenylene group depicted in Formula (I) includes at least one alkyl $R^1$ group. As discussed above, any suitable isomer may be used. Thus, for example, a linear butyl group may be used or a branched isomer such as an isobutyl group or a tert-butyl group may be used. In one embodiment, a tert-butyl group (and more preferably a tert-butyl moiety) is a preferred $R^1$ group.

As previously mentioned, it is contemplated that $R^1$ may include one or more cyclic groups. In addition, $R^1$ may form a cyclic or polycyclic group with one or more other $R^1$ groups or $R^2$.

In some embodiments, one or both phenylene groups depicted in Formula (I) include an $R^1$ group located ortho to an oxygen atom that is a halogen atom, more preferably a higher molecular weight halogen such as bromine or iodine, however, in preferred embodiments, the polyhydric phenol of Formula (I) does not include any halogen atoms. Moreover, in presently preferred embodiments, the developer may be free of halogen atoms.

In some embodiments, a suitable $R^1$ group is selected and positioned at the ortho position such that a width "f" measured perpendicular from a center-line of the phenylene group (or other suitable aryl group) to the maximal outside extent of the van der Waals volume of $R^1$ (corresponding to the radius of the van der Waals radius of $R^1$) is greater than about 4.5 Angstroms. This width measurement may be determined via theoretical calculation using suitable molecular modeling software and is illustrated below.

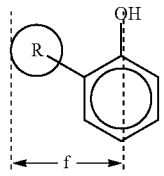

As illustrated above, the centerline for the depicted phenylene group includes the carbon atom to which the phenol hydroxyl group attaches and the para carbon atom. For example, while not intending to be bound by any theory, it is believed that it is generally desirable that f be greater than about 4.5 Angstroms if $R^2$ is a —$C(CH_3)_2$— group. In some embodiments, $R^1$ may be selected and positioned at an ortho position such that f is less than about 4.5 Angstroms. For example, if $R^2$ is a methylene bridge (—$CH_2$—), then in some embodiments $R^1$ can be selected and positioned such that f is less than about 4.5 Angstroms. For example, this is believed to be the case for certain preferred compounds of Formula (I), such as 4,4'-methylenebis(2,6-dimethylphenol).

$R^2$ is present or absent in the compound of Formula (IA) depending on whether n is 0 or 1. When $R^2$ is absent, either (i) a carbon atom of one phenylene ring is covalently attached to a carbon atom of the other phenylene ring (which occurs when w is 4) or (ii) the phenylene groups depicted in Formula (IA) join to form a fused ring system (which occurs when w is 3 and the two phenylene groups are so fused). In some embodiments, $R^2$ (or the ring-ring covalent linkage if $R^2$ is absent) is preferably attached to at least one, and more preferably both, phenylene rings at a para position (e.g., 1,4 position) relative to the oxygen atom depicted in Formula (IA). An embodiment of the compound of Formula (IA), in which n is 0, w is 3, and v is independently 0 to 3 such that the two phenylene groups have joined to form a naphthalene group, is depicted below:

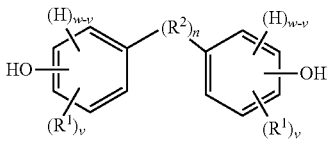

$R^2$ can be any suitable divalent group including, for example, carbon-containing groups (which may optionally include heteroatoms such as, e.g., N, O, P, S, Si, a halogen atom, etc.), sulfur-containing groups (including, e.g., a sulfur atom, a sulfinyl group (—(S(O)—), a sulfonyl group (—$S(O_2)$—), etc.), oxygen-containing groups (including, e.g., an oxygen atom, a ketone group, etc.), nitrogen-containing groups, or a combination thereof.

In preferred embodiments of the compound of Formula (IA), $R^2$ is present and is typically an organic group containing less than about 15 carbon atoms, and even more typically 1 or 4-15 carbon atoms. In some embodiments, $R^2$ includes 8 or more carbon atoms. $R^2$ will typically be a saturated or unsaturated hydrocarbon group, more typically a saturated divalent alkyl group, and most preferably an alkyl group that doesn't constrain the movement of the connected phenylene groups in an orientation similar to that of diethylstilbestrol or dienestrol. In some embodiments, $R^2$ may include one or more cyclic groups, which may be aromatic or alicyclic and can optionally include heteroatoms. The one or more optional cyclic groups of $R^2$ can be present, for example, (i) in a chain connecting the two phenylene groups depicted in Formula (IA), (ii) in a pendant group attached to a chain connecting the two phenylene groups, or both (i) and (ii).

The atomic weight of the $R^2$ group, if present, may be any suitable atomic weight. Typically, however, $R^2$ has an atomic weight of less than about 500 Daltons, less than about 400 Daltons, less than about 300 Daltons, or less than about p; 250 Daltons.

In some embodiments, $R^2$ includes a carbon atom that is attached to a carbon atom of each of the phenylene groups depicted in Formula (I). For example, $R^2$ can have a structure of the formula —$C(R^7)(R^8)$—, wherein $R^7$ and $R^8$ are each independently a hydrogen atom, a halogen atom, an organic group, a sulfur-containing group, or a nitrogen-containing group, and wherein $R^7$ and $R^8$ can optionally join to form a cyclic group. In some embodiments, at least one of $R^7$ and $R^8$ are hydrogen atoms, and more preferably both $R^7$ and $R^8$ are hydrogen atoms. In one preferred embodiment, $R^2$ is a divalent methylene group (—$CH_2$—). While not intending to be bound by theory, it is believed that it may be generally desirable to avoid using an $R^2$ group wherein each of $R^7$ and $R^8$ are methyl (—$CH_3$) groups. It may also be generally desirable to avoid using an $R^2$ group in which $R^7$ and $R^8$ join to form a monocyclic cyclohexyl group.

It is also thought to be generally desirable to avoid using either of the following "constrained" unsaturated structures (i) or (ii) as $R^2$: (i) —$C(R^9)$=$C(R^9)$— or (ii) —$C(=C(R^{10})_y)$—$C(=C(R^{10})_y)$—, wherein y is 1 or 2 and each of $R^9$ or $R^{10}$ is independently a hydrogen atom, a halogen atom, an organic group, or a monovalent group. For example, the following unsaturated structures (i) and (ii) are preferably avoided: (i) —$C(CH_2CH_3)$=$C(CH_2CH_3)$— and (ii) —$C(=CHCH_3)$—$C(=CHCH_3)$—.

While not intending to be bound by theory it is believed that a suitably low atomic weight $R^2$ group such as, e.g., —$CH_2$— (14 Daltons), can help avoid estrogenic activity. In some embodiments where $R^2$ is a —$C(R^7)(R^8)$— group, it may be desirable that $R^2$ have an atomic weight of less than 42 Daltons or less than 28 Daltons. It is also believed that a suitably high atomic weight $R^2$ can also help interfere with the ability of a polyhydric phenol to function as an agonist for a human estrogen receptor. In some embodiments where $R^2$ is a —$C(R^7)(R^8)$— group, it may be desirable that $R^2$ have an atomic weight that is greater than about: 125, 150, 175, or 200 Daltons. By way of example, a diphenol compound has been determined to be appreciably non-estrogenic that: (a) is not "hindered" (the phenol hydroxyl groups are not surrounded by ortho hydrogens) and (b) has an $R^2$ group in the form of —$C(R^7)(R^8)$— having an atomic weight greater than 200 Daltons.

While not intending to be bound to theory, preferred $R^2$ groups include divalent groups that promote that the orientation of a polyhydric phenol compound in a three-dimensional configuration that is sufficiently different from 17β-estradiol or other compounds (e.g., diethylstilbestrol) having estrogenic activity. For example, while not intending to be bound to theory, it is believed that the presence of $R^2$ as an unsubstituted methylene bridge (—$CH_2$—) can contribute to the reduction or elimination of estrogenic activity. It is also contemplated that a singly substituted methylene bridge having one hydrogen attached to the central carbon atom of the methylene bridge (—$C(R^7)(H)$—; see, e.g. the $R^2$ group of 4,4'Butylidenebis(2-t-butyl-5-methylphenol)) may also contribute such a beneficial effect, albeit perhaps to a lesser extent.

In some embodiments, $R^2$ is of the formula —$C(R^7)(R^8)$— wherein $R^7$ and $R^8$ form a ring that includes one or more heteroatoms. In one such embodiment, the ring formed by $R^7$ and $R^8$ further includes one or more additional cyclic groups such as, e.g., one or more aryl cyclic groups (e.g., two phenylene rings).

In one embodiment, $R^2$ is of the formula —$C(R^7)(R^8)$— wherein at least one of $R^7$ and $R^8$ form a ring with an $R^1$ of the depicted phenylene group. In one such embodiment, each of $R^7$ and $R^8$ forms such a ring with a different depicted phenylene group.

The hydroxyl group of a phenylene ring depicted in Formula (I) can be positioned on the ring at any position relative to $R^2$ (or relative to the other phenylene ring if $R^2$ is absent). In some embodiments, the hydroxyl group and $R^2$ are located at para positions relative to one another. In other embodiments, the hydroxyl group atom and $R^2$ may be located ortho or meta to one another.

In preferred embodiments, the substituted phenylene groups of Formula (IA) are symmetric relative to one another. Stated otherwise, the substituted phenylene groups are preferably formed from the same phenol compound, thereby resulting in the same substituent groups on each ring located at the same ring positions. An example of a compound having symmetric phenylene groups is provided below.

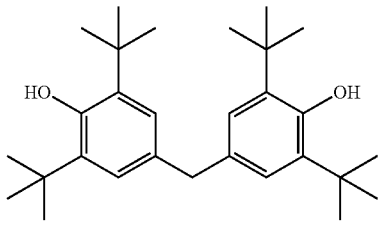

An example of a compound having phenylene groups that are not symmetric is provided below, in which a methyl group is at a meta position on one ring and at an ortho position on the other.

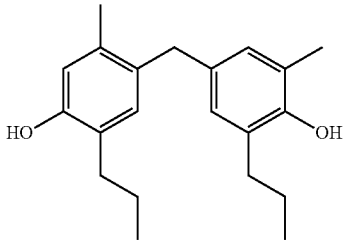

Preferred compounds of Formula (I) do not exhibit appreciable estrogenic activity. Preferred appreciably non-estrogenic compounds exhibit a degree of estrogen agonist activity, in a competent in vitro human estrogen receptor assay, that is preferably less than that exhibited by 4,4'-(propane-2,2-diyl)diphenol in the assay, even more preferably less than that exhibited by bisphenol S in the assay, even more preferably less than that exhibited by 4,4'-(propane-2,2-diyl) bis(2,6-dibromophenol) in the assay, and optimally less than about that exhibited by 2,2-bis(4-hydroxyphenyl)propanoic acid in the assay. It has been found that compounds such as 4,4'-methylenebis(2,6-di-t-butylphenol), methylenebis(4-methyl-6-t-butylphenol), 4,4'-methylenebis(2,6-dimethylphenol), 4,4'-butylidenebis(2-t-butyl-5-methylphenol), and 2,5-di-t-butylhydroquinone do not exhibit appreciable estrogenic activity in a suitable in vitro assay whose results are known to be directly correlated to the results of the MCF-7 cell proliferation assay ("MCF-7 assay") through analysis of common reference compounds.

The MCF-7 assay is a useful test for assessing whether a polyhydric phenol compound is appreciably non-estrogenic. The MCF-7 assay uses MCF-7, clone WS8 cells to measure whether and to what extent a substance induces cell proliferation via estrogen receptor (ER)-mediated pathways. The method is described in "Test Method Nomination: MCF-7 Cell Proliferation Assay of Estrogenic Activity" submitted for validation by CertiChem, Inc. to the National Toxicology Program Interagency Center for the Evaluation of Alternative Toxicological Methods (NICEATM) on Jan. 19, 2006 (available online at http://iccvam.niehs.nih.gov/methods/endocrine/endodocs/SubmDoc.pdf).

A brief summary of the method of the aforementioned MCF-7 assay is provided below. MCF-7, clone WS8 cells are maintained at 37° C. in RMPI (Roswell Park Memorial Institute medium) containing Phenol Red (e.g., GIBCO Catalog Number 11875119) and supplemented with the indicated additives for routine culture. An aliquot of cells maintained at 37° C. are grown for two days in phenol-free media containing 5% charcoal stripped fetal bovine serum in a 25 $cm^2$ tissue culture flask. Using a robotic dispenser such as an epMotion 5070 unit, MCF-7 cells are then seeded at 400 cells per well in 0.2 ml of hormone-free culture medium in Corning 96-well plates. The cells are adapted for 3 days in the hormone-free culture medium prior to adding the chemical to be assayed for estrogenic activity. The media containing the test chemical is replaced daily for 6 days. At the end of the 7 day exposure to the test chemical, the media is removed, the wells are washed once with 0.2 ml of HBSS (Hanks' Balanced Salt Solution), and then assayed to quantify amounts of DNA per well using a micro-plate modification of the Burton diphenylamine (DPA) assay, which is used to calculate the level of cell proliferation.

Examples of appreciably non-estrogenic polyhydric phenols include polyhydric phenols that, when tested using the MCF-7 assay, exhibit a Relative Proliferative Effect ("RPE") having a logarithmic value (with base 10) of less than about −2.0, more preferably an RPE of −3 or less, and even more preferably an RPE of −4 or less. RPE is the ratio between the EC50 of the test chemical and the EC50 of the control substance 17-beta estradiol times 100, where EC50 is "effective concentration 50%" or half-maximum stimulation concentration for cell proliferation measured as total DNA in the MCF-7 assay.

Table 1 shown below includes exemplary preferred polyhydric phenols and their expected or measured logarithmic RPE values in the MCF-7 assay.

TABLE 1

| Polyhydric Compound of Formula (I) | Structure | Reference Compound | Log RPE |
|---|---|---|---|
| | | 17β-estradiol | 2.00 |
| | | diethyl-stilbestrol | about 2 |
| | | dienestrol | about 2 |
| | | Genistein | −2 |
| | | Bisphenol S | −2 |
| | | Bisphenol F | −2 |
| 4,4'-isopropylidenebis(2,6-dimethylphenol) | 1 | | −2 |
| 4,4'-(propane-2,2-diyl)bis(2,6-dibromophenol) | 16 | | −3 |
| 4,4'-(ethane-1,2-diyl)bis(2,6-dimethylphenol) | 2 | | −3 |
| 4,4',4''-(ethane-1,1,1-triyl)triphenol | 3 | | −3 |
| 4,4'-(1-phenylethane-1,1-diyl)diphenol | 4 | | −3 |
| 2,2-bis(4-hydroxyphenyl)-propanoic acid | 5 | | less than −4 |
| 4,4'-methylenebis(2,6-dimethylphenol) | 6 | | less than −4 |
| 4,4'-butylidenebis(2-t-butyl-5-methylphenol) | 7 | | less than −4 |
| 4,4'-methylenebis(2,6-di-t-butylphenol) | 8 | | less than −4 |
| 2,2'-methylenebis(4-methyl-6-t-butylphenol | 9 | | less than −4 |
| 4,4'-(1,4-phenylenebis-(propane-2,2-diyl))diphenol | 10 | | less than −4 |
| 2,2'methylenebis(phenol) | 11 | | less than −4 |
| 2,5-di-t-butylhydroquinone | 12 | | less than −4 |
| 2,2'-Methylenebis(6-(1-methylcyclohexyl)-4-methylphenol | 13 | | less than −4 |
| 2,2'-Methylenebis(6-t-butyl-4-methylphenol) | 14 | | less than −4 |
| 2,2'Methylenebis(4-ethyl-6-t-butylphenol) | 15 | | less than −4 |

Structures 1 through 16 as identified in Table 1 are also shown below:
1
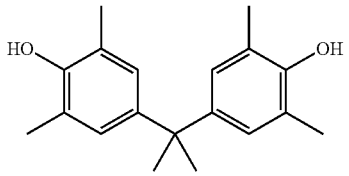
2
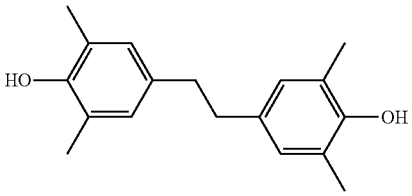
3
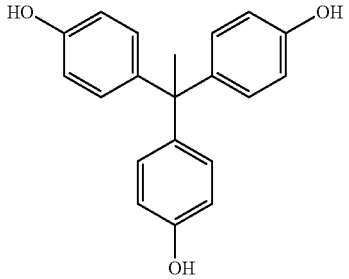
4
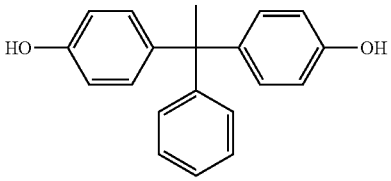
5
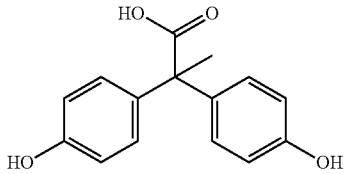
6
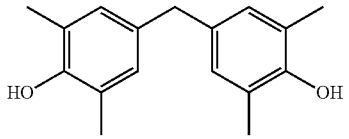
7
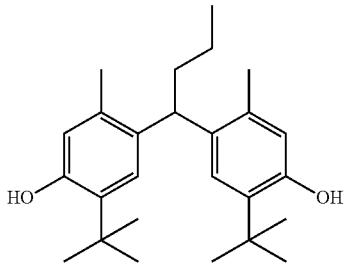
-continued
8
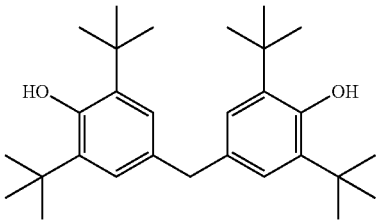
9
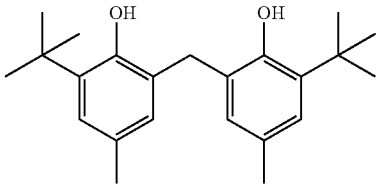
10
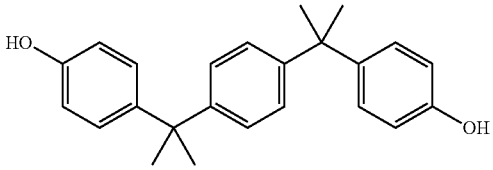
11
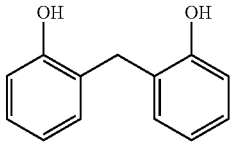
12
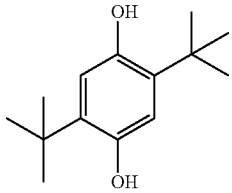
13
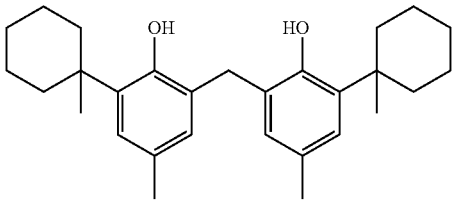
14
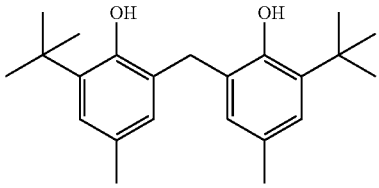
15
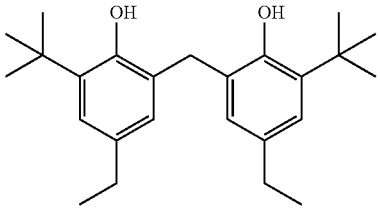

-continued

16

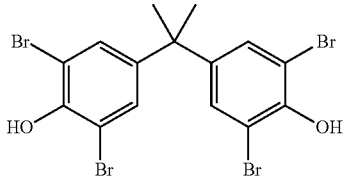

Compounds having no appreciable estrogenic activity may be beneficial in the event that any unreacted, residual compound may be present in a thermally responsive coating composition. While the balance of scientific data does not indicate that the presence in such coating compositions of very small amounts of residual compounds having estrogenic activity in an in vitro recombinant cell assay pose a human health concern, the use of compounds having no appreciable estrogenic activity in such an assay may nonetheless be desirable from a public perception standpoint. Thus, in preferred embodiments, the polyhydric phenol compounds do not exhibit appreciable estrogenic activity in the MCF-7 test.

While not intending to be bound by theory, as previously discussed, it is believed that the presence of substituent groups (e.g., a group other than a hydrogen atom) at one or more of the ortho or meta positions of each phenylene ring of the Formula (IA) compound, relative to the phenol hydroxyl group of each ring, can reduce or effectively eliminate any estrogenic activity. It is believed that the inhibition/elimination of estrogenic activity may be attributable to one or more of the following: (a) steric hindrance of the phenol hydroxyl group (which may cause the overall polyhydric phenol structure to be sufficiently different from estrogenically active compounds such as diethylstilbestrol), (b) the compound having an increased molecular weight due to the presence of the one or more substituent groups, (c) the presence of polar groups or (d) ortho hydroxyl groups relative to $R^2$. Substitution at one or both of the ortho positions of each phenylene ring is presently preferred for certain embodiments as it is believed that ortho substitution can provide the greatest steric hindrance for the hydroxyl group.

As previously discussed, structural features other than the presence of suitable $R^1$ groups (e.g., features such as (b), (c), and (d) of the preceding paragraph) are believed to inhibit or eliminate estrogenic activity, even in the absence of any $R^1$ groups.

It is believed that molecular weight may be a structural characteristic pertinent to whether a polyhydric phenol is appreciably non-estrogenic. For example, while not intending to be bound by theory, it is believed that if a sufficient amount of relatively "densely" packed molecular weight is present in a polyhydric phenol, it can prevent the compound from being able to fit into the active site of an estrogen receptor (irrespective of whether the polyhydric phenol includes any ortho or meta $R^1$ groups). In some embodiments, it may be beneficial to form a polyether polymer from one or more polyhydric phenols (whether "hindered" or not) that includes at least the following number of carbon atoms: 20, 21, 22, 23, 24, 25, or 26 carbon atoms.

The presence of one or more polar groups on the polyhydric phenol compounds of Formula (I) may be beneficial in certain embodiments, particularly for certain embodiments of Formula (IA). The polar groups may be located at any suitable location of the compounds of Formula (I), including in $R^1$ or $R^2$. Suitable polar groups may include ketone, carboxyl, carbonate, hydroxyl, phosphate, sulfoxide, and the like, any other polar groups disclosed herein, and combinations thereof.

The below compounds of Formula (I) may also be used in certain embodiments if desired.

17

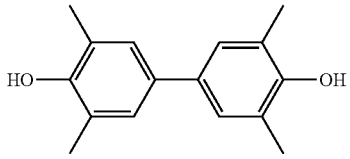

18

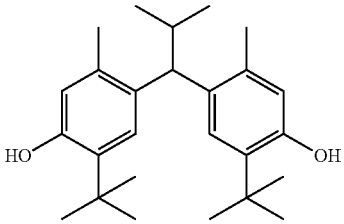

19

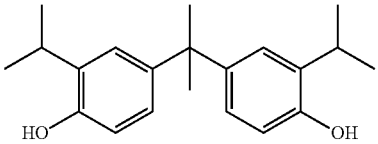

20

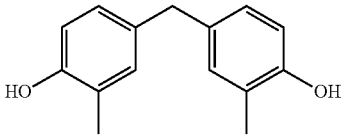

The below compounds are not presently preferred, but may be used in certain embodiments, if desired.

21

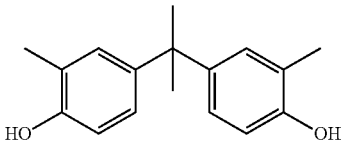

22

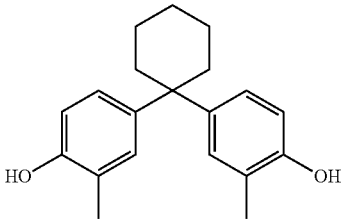

23

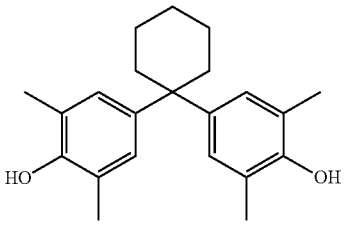

Additional diphenol compounds that may have utility in producing the disclosed developer are provided below. While the diphenol structures listed below are not "hindered" in the sense of having bulky substituent groups at one or more ortho or meta positions of the phenylene ring(s), it is contemplated that each of the below polyhydric phenol structures may be used in place of, or in addition to, the compounds of Formula (I). Such compounds are believed to be appreciably non-estrogenic for one or more of the reasons previously described herein.

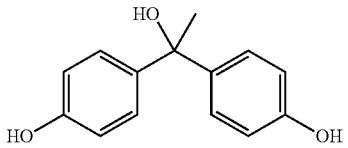

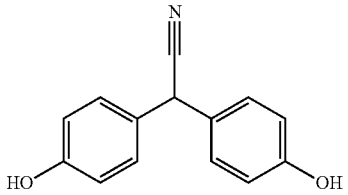

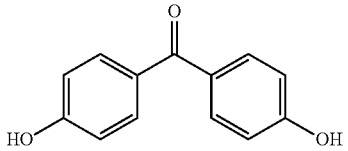

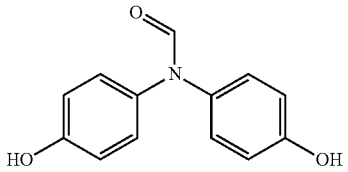

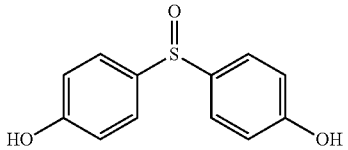

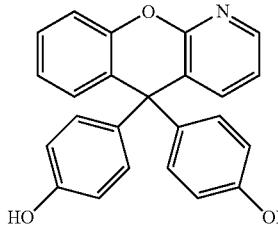

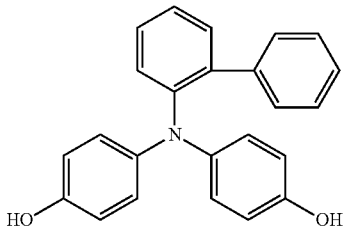

-continued

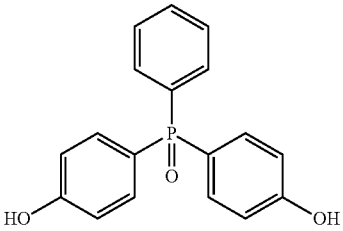

Compounds of Formula (I) wherein each of the depicted phenylene groups include one or two ortho $R^1$ groups (relative to the depicted oxygen atom) are presently preferred. To further illustrate such structures, Table 2 shown below exemplifies some non-limiting combinations of one or more ortho $R^1$ and $R^2$, if present, for a given phenylene group. Table 2 is non-limiting with respect to the ring position of $R^2$ (e.g., ortho, meta, para), although typically $R^2$, if present, will be located at a para position relative to the oxygen atom. The columns labeled "Ortho Position A" and "Ortho Position B" indicate the $R^1$ group present at each ortho position of the phenylene group (assuming $R^2$ is not located at an ortho position). Positions "A" or "B" can be either ortho position relative to the depicted oxygen atom. If $R^2$ is located at an ortho position of the phenylene group, then the group listed in the "Ortho Position B" column is not present. Typically, though not required, the phenylene groups in a given compound of Formula (I) will be "symmetric" relative to the second phenylene group such that the same ortho group (as delineated in the ortho position column "A" or "B") is located on each ring at the same ortho position.

Table 2 is also intended as a listing of independent examples of $R^1$ or $R^2$, as well as examples of combinations of $R^1$ and $R^2$ (regardless of whether $R^1$ is ortho or meta relative to the oxygen atom, whether other $R^1$ are present in a particular phenylene group, or whether the one or more Ware the same for both of the phenylene groups).

| Ortho Position "A" | Ortho Position "B" | $R^2$ |
|---|---|---|
| Butyl | Hydrogen | 2-Butylidene |
| Butyl | Methyl | 2-Butylidene |
| Butyl | Ethyl | 2-Butylidene |
| Butyl | Propyl | 2-Butylidene |
| Butyl | isopropyl | 2-Butylidene |
| Butyl | Butyl | 2-Butylidene |
| Ethyl | Hydrogen | 2-Butylidene |
| Ethyl | Methyl | 2-Butylidene |
| Ethyl | Ethyl | 2-Butylidene |
| Isopropyl | Hydrogen | 2-Butylidene |
| Isopropyl | Methyl | 2-Butylidene |
| Isopropyl | Ethyl | 2-Butylidene |
| Isopropyl | Propyl | 2-Butylidene |
| Isopropyl | isopropyl | 2-Butylidene |
| Methyl | Hydrogen | 2-Butylidene |
| Methyl | Methyl | 2-Butylidene |
| Propyl | Hydrogen | 2-Butylidene |
| Propyl | Methyl | 2-Butylidene |
| Propyl | Ethyl | 2-Butylidene |
| Propyl | Propyl | 2-Butylidene |
| sec-Butyl | Hydrogen | 2-Butylidene |
| sec-Butyl | Methyl | 2-Butylidene |
| sec-Butyl | Ethyl | 2-Butylidene |
| sec-Butyl | Propyl | 2-Butylidene |
| sec-Butyl | isopropyl | 2-Butylidene |
| sec-Butyl | Butyl | 2-Butylidene |
| sec-Butyl | sec-Butyl | 2-Butylidene |
| tert-Butyl | Hydrogen | 2-Butylidene |

-continued

| Ortho Position "A" | Ortho Position "B" | $R^2$ |
|---|---|---|
| tert-Butyl | Methyl | 2-Butylidene |
| tert-Butyl | Ethyl | 2-Butylidene |
| tert-Butyl | Propyl | 2-Butylidene |
| tert-Butyl | isopropyl | 2-Butylidene |
| tert-Butyl | Butyl | 2-Butylidene |
| tert-Butyl | sec-Butyl | 2-Butylidene |
| tert-Butyl | tert-Butyl | 2-Butylidene |
| Butyl | Hydrogen | Butylene |
| Butyl | Methyl | Butylene |
| Butyl | Ethyl | Butylene |
| Butyl | Propyl | Butylene |
| Butyl | isopropyl | Butylene |
| Butyl | Butyl | Butylene |
| Ethyl | Hydrogen | Butylene |
| Ethyl | Methyl | Butylene |
| Ethyl | Ethyl | Butylene |
| Isopropyl | Hydrogen | Butylene |
| Isopropyl | Methyl | Butylene |
| Isopropyl | Ethyl | Butylene |
| Isopropyl | Propyl | Butylene |
| Isopropyl | isopropyl | Butylene |
| Methyl | Hydrogen | Butylene |
| Methyl | Methyl | Butylene |
| Propyl | Hydrogen | Butylene |
| Propyl | Methyl | Butylene |
| Propyl | Ethyl | Butylene |
| Propyl | Propyl | Butylene |
| sec-Butyl | Hydrogen | Butylene |
| sec-Butyl | Methyl | Butylene |
| sec-Butyl | Ethyl | Butylene |
| sec-Butyl | Propyl | Butylene |
| sec-Butyl | isopropyl | Butylene |
| sec-Butyl | Butyl | Butylene |
| sec-Butyl | sec-Butyl | Butylene |
| tert-Butyl | Hydrogen | Butylene |
| tert-Butyl | Methyl | Butylene |
| tert-Butyl | Ethyl | Butylene |
| tert-Butyl | Propyl | Butylene |
| tert-Butyl | isopropyl | Butylene |
| tert-Butyl | Butyl | Butylene |
| tert-Butyl | sec-Butyl | Butylene |
| tert-Butyl | tert-Butyl | Butylene |
| Butyl | Hydrogen | Ethylidene |
| Butyl | Methyl | Ethylidene |
| Butyl | Ethyl | Ethylidene |
| Butyl | Propyl | Ethylidene |
| Butyl | isopropyl | Ethylidene |
| Butyl | Butyl | Ethylidene |
| Ethyl | Hydrogen | Ethylidene |
| Ethyl | Methyl | Ethylidene |
| Ethyl | Ethyl | Ethylidene |
| Isopropyl | Hydrogen | Ethylidene |
| Isopropyl | Methyl | Ethylidene |
| Isopropyl | Ethyl | Ethylidene |
| Isopropyl | Propyl | Ethylidene |
| Isopropyl | isopropyl | Ethylidene |
| Methyl | Hydrogen | Ethylidene |
| Methyl | Methyl | Ethylidene |
| Propyl | Hydrogen | Ethylidene |
| Propyl | Methyl | Ethylidene |
| Propyl | Ethyl | Ethylidene |
| Propyl | Propyl | Ethylidene |
| sec-Butyl | Hydrogen | Ethylidene |
| sec-Butyl | Methyl | Ethylidene |
| sec-Butyl | Ethyl | Ethylidene |
| sec-Butyl | Propyl | Ethylidene |
| sec-Butyl | isopropyl | Ethylidene |
| sec-Butyl | Butyl | Ethylidene |
| sec-Butyl | sec-Butyl | Ethylidene |
| tert-Butyl | Hydrogen | Ethylidene |
| tert-Butyl | Methyl | Ethylidene |
| tert-Butyl | Ethyl | Ethylidene |
| tert-Butyl | Propyl | Ethylidene |
| tert-Butyl | isopropyl | Ethylidene |
| tert-Butyl | Butyl | Ethylidene |
| tert-Butyl | sec-Butyl | Ethylidene |
| tert-Butyl | tert-Butyl | Ethylidene |

-continued

| Ortho Position "A" | Ortho Position "B" | $R^2$ |
|---|---|---|
| Butyl | Hydrogen | Methylidene |
| Butyl | Methyl | Methylidene |
| Butyl | Ethyl | Methylidene |
| Butyl | Propyl | Methylidene |
| Butyl | isopropyl | Methylidene |
| Butyl | Butyl | Methylidene |
| Ethyl | Hydrogen | Methylidene |
| Ethyl | Methyl | Methylidene |
| Ethyl | Ethyl | Methylidene |
| Isopropyl | Hydrogen | Methylidene |
| Isopropyl | Methyl | Methylidene |
| Isopropyl | Ethyl | Methylidene |
| Isopropyl | Propyl | Methylidene |
| Isopropyl | isopropyl | Methylidene |
| Methyl | Hydrogen | Methylidene |
| Methyl | Methyl | Methylidene |
| Propyl | Hydrogen | Methylidene |
| Propyl | Methyl | Methylidene |
| Propyl | Ethyl | Methylidene |
| Propyl | Propyl | Methylidene |
| sec-Butyl | Hydrogen | Methylidene |
| sec-Butyl | Methyl | Methylidene |
| sec-Butyl | Ethyl | Methylidene |
| sec-Butyl | Propyl | Methylidene |
| sec-Butyl | isopropyl | Methylidene |
| sec-Butyl | Butyl | Methylidene |
| sec-Butyl | sec-Butyl | Methylidene |
| tert-Butyl | Hydrogen | Methylidene |
| tert-Butyl | Methyl | Methylidene |
| tert-Butyl | Ethyl | Methylidene |
| tert-Butyl | Propyl | Methylidene |
| tert-Butyl | isopropyl | Methylidene |
| tert-Butyl | Butyl | Methylidene |
| tert-Butyl | sec-Butyl | Methylidene |
| tert-Butyl | tert-Butyl | Methylidene |
| Butyl | Hydrogen | Propylidene |
| Butyl | Methyl | Propylidene |
| Butyl | Ethyl | Propylidene |
| Butyl | Propyl | Propylidene |
| Butyl | isopropyl | Propylidene |
| Butyl | Butyl | Propylidene |
| Ethyl | Hydrogen | Propylidene |
| Ethyl | Methyl | Propylidene |
| Ethyl | Ethyl | Propylidene |
| Isopropyl | Hydrogen | Propylidene |
| Isopropyl | Methyl | Propylidene |
| Isopropyl | Ethyl | Propylidene |
| Isopropyl | Propyl | Propylidene |
| Isopropyl | isopropyl | Propylidene |
| Methyl | Hydrogen | Propylidene |
| Methyl | Methyl | Propylidene |
| Propyl | Hydrogen | Propylidene |
| Propyl | Methyl | Propylidene |
| Propyl | Ethyl | Propylidene |
| Propyl | Propyl | Propylidene |
| sec-Butyl | Hydrogen | Propylidene |
| sec-Butyl | Methyl | Propylidene |
| sec-Butyl | Ethyl | Propylidene |
| sec-Butyl | Propyl | Propylidene |
| sec-Butyl | isopropyl | Propylidene |
| sec-Butyl | Butyl | Propylidene |
| sec-Butyl | sec-Butyl | Propylidene |
| tert-Butyl | Hydrogen | Propylidene |
| tert-Butyl | Methyl | Propylidene |
| tert-Butyl | Ethyl | Propylidene |
| tert-Butyl | Propyl | Propylidene |
| tert-Butyl | isopropyl | Propylidene |
| tert-Butyl | Butyl | Propylidene |
| tert-Butyl | sec-Butyl | Propylidene |
| tert-Butyl | tert-Butyl | Propylidene |
| Butyl | Hydrogen | 1-Phenylethylidene |
| Butyl | Methyl | 1-Phenylethylidene |
| Butyl | Ethyl | 1-Phenylethylidene |
| Butyl | Propyl | 1-Phenylethylidene |
| Butyl | isopropyl | 1-Phenylethylidene |
| Butyl | Butyl | 1-Phenylethylidene |
| Ethyl | Hydrogen | 1-Phenylethylidene |

-continued

| Ortho Position "A" | Ortho Position "B" | $R^2$ |
|---|---|---|
| Ethyl | Methyl | 1-Phenylethylidene |
| Ethyl | Ethyl | 1-Phenylethylidene |
| Isopropyl | Hydrogen | 1-Phenylethylidene |
| Isopropyl | Methyl | 1-Phenylethylidene |
| Isopropyl | Ethyl | 1-Phenylethylidene |
| Isopropyl | Propyl | 1-Phenylethylidene |
| Isopropyl | isopropyl | 1-Phenylethylidene |
| Methyl | Hydrogen | 1-Phenylethylidene |
| Methyl | Methyl | 1-Phenylethylidene |
| Propyl | Hydrogen | 1-Phenylethylidene |
| Propyl | Methyl | 1-Phenylethylidene |
| Propyl | Ethyl | 1-Phenylethylidene |
| Propyl | Propyl | 1-Phenylethylidene |
| sec-Butyl | Hydrogen | 1-Phenylethylidene |
| sec-Butyl | Methyl | 1-Phenylethylidene |
| sec-Butyl | Ethyl | 1-Phenylethylidene |
| sec-Butyl | Propyl | 1-Phenylethylidene |
| sec-Butyl | isopropyl | 1-Phenylethylidene |
| sec-Butyl | Butyl | 1-Phenylethylidene |
| sec-Butyl | sec-Butyl | 1-Phenylethylidene |
| tert-Butyl | Hydrogen | 1-Phenylethylidene |
| tert-Butyl | Methyl | 1-Phenylethylidene |
| tert-Butyl | Ethyl | 1-Phenylethylidene |
| tert-Butyl | Propyl | 1-Phenylethylidene |
| tert-Butyl | isopropyl | 1-Phenylethylidene |
| tert-Butyl | Butyl | 1-Phenylethylidene |
| tert-Butyl | sec-Butyl | 1-Phenylethylidene |
| tert-Butyl | tert-Butyl | 1-Phenylethylidene |
| Butyl | Hydrogen | Diphenylmethylidene |
| Butyl | Methyl | Diphenylmethylidene |
| Butyl | Ethyl | Diphenylmethylidene |
| Butyl | Propyl | Diphenylmethylidene |
| Butyl | isopropyl | Diphenylmethylidene |
| Butyl | Butyl | Diphenylmethylidene |
| Ethyl | Hydrogen | Diphenylmethylidene |
| Ethyl | Methyl | Diphenylmethylidene |
| Ethyl | Ethyl | Diphenylmethylidene |
| Isopropyl | Hydrogen | Diphenylmethylidene |
| Isopropyl | Methyl | Diphenylmethylidene |
| Isopropyl | Ethyl | Diphenylmethylidene |
| Isopropyl | Propyl | Diphenylmethylidene |
| Isopropyl | isopropyl | Diphenylmethylidene |
| Methyl | Hydrogen | Diphenylmethylidene |
| Methyl | Methyl | Diphenylmethylidene |
| Propyl | Hydrogen | Diphenylmethylidene |
| Propyl | Methyl | Diphenylmethylidene |
| Propyl | Ethyl | Diphenylmethylidene |
| Propyl | Propyl | Diphenylmethylidene |
| sec-Butyl | Hydrogen | Diphenylmethylidene |
| sec-Butyl | Methyl | Diphenylmethylidene |
| sec-Butyl | Ethyl | Diphenylmethylidene |
| sec-Butyl | Propyl | Diphenylmethylidene |
| sec-Butyl | isopropyl | Diphenylmethylidene |
| sec-Butyl | Butyl | Diphenylmethylidene |
| sec-Butyl | sec-Butyl | Diphenylmethylidene |
| tert-Butyl | Hydrogen | Diphenylmethylidene |
| tert-Butyl | Methyl | Diphenylmethylidene |
| tert-Butyl | Ethyl | Diphenylmethylidene |
| tert-Butyl | Propyl | Diphenylmethylidene |
| tert-Butyl | isopropyl | Diphenylmethylidene |
| tert-Butyl | Butyl | Diphenylmethylidene |
| tert-Butyl | sec-Butyl | Diphenylmethylidene |
| tert-Butyl | tert-Butyl | Diphenylmethylidene |

The disclosed developers may be used alone or in combination with any other known developer. The developer preferably is at least substantially free of mobile BPA, and more preferably is completely free of BPA. More preferably, the developer is at least substantially free, and more preferably completely free, of mobile or bound polyhydric phenols having estrogenic agonist activity greater than or equal to that of 4,4'-(propane-2,2-diyl)diphenol, more preferably greater than or equal to that of BPS, even more preferably greater than or equal to that of 2,2-bis-(4-hydroxyphenyl)-1-propanol.

The phenol hydrogen atoms (e.g. the hydrogen atoms of the depicted hydroxyl groups in Formula I) in the disclosed developer may have, for example, dissociation constant(s) (pKa values) of about 9 to about 11.50.

The record material on which the thermally responsive composition is applied typically is a substrate or support, and is generally in sheet form. Sheets may be referred to as support members and are understood to also mean webs, ribbons, tapes, belts, films, cards and the like. The substrate or support can be opaque, transparent or translucent and could, itself, be colored or not. The substrate and support can be fibrous including, for example, paper and filamentous synthetic materials. It can be a film including, for example, cellophane and synthetic polymeric sheets cast, extruded, or otherwise formed.

The components of the thermally responsive composition are preferably in substantially contiguous relationship, and substantially homogeneously distributed throughout a coated layer or layers of composition deposited on the substrate or support. These reactive components may be in the same coated layer or layers, or isolated or positioned in separate layers (e.g. adjacent layers). In other words, one component such as the dye can be positioned in a first layer, and another component such as the developer can be positioned in a subsequent layer or layers or vice-versa. The thermally responsive composition can optionally be applied to all of the substrate or spot printed on a certain portion. All such arrangements are understood herein as placing the thermally responsive component or components in substantially contiguous relationship.

The thermally responsive record material can optionally include a variety of precoats such as a base layer of clay, and absorptive pigments such as kaolin clays, insulators such as hollow sphere particles, pigments, particulate clays, starch, or synthetic polymeric materials. Hollow sphere particles are commercially available such as the ROPAQUE materials of Rohm and Haas.

Optionally, the thermally responsive composition can be formed as a top layer on the substrate, which top layer is then overcoated with a protective layer top coat or barrier layer formed from one or more water soluble or dispersible polymeric materials such as polyvinyl alcohol, carboxylated polyvinyl alcohol, methyl or ethyl cellulose, polyacrylamide, gelatin, starch, polyvinyl pyrrolidone and the like.

Optionally, a protective layer using the same or different materials can be applied as a back coat to the thermally responsive record material. The above-mentioned precoats, for example hollow sphere particles, pigments, clays and synthetic polymeric particulate materials, can also be usefully applied as the back coat.

In manufacturing the thermally responsive record material, a composition is prepared which typically includes a fine dispersion of the components such as the dye and developer, an appropriate polymeric binder material, a surface active agent and one or more other optional additives in an aqueous coating medium or other dispersion vehicle. The thermally responsive composition can additionally contain inert pigments, such as clay, talc, aluminum hydroxide, calcined kaolin clay and calcium carbonate; synthetic pigments, such as urea-formaldehyde resin pigments; natural waxes such as Carnuba wax; synthetic waxes; lubricants such as a zinc stearate; wetting agents; defoamers; and antioxidants. Sensitizers can also be included. Sensitizers can, for example, include acetoaceto-toluidine, phenyl-1-hydroxy-2-naphthoate, 1,2-diphenoxyethane, or p-benzylbiphenyl or mixtures thereof. The sensitizer or modifier typically does not impart significant imaging on its own, but as a relatively low melt point solid, acts as a solvent to facilitate reaction between the dye and developer.

The thermally responsive composition components are substantially insoluble in the dispersion vehicle (preferably water) and are ground to an individual average particle size of between about 1 micrometer to about 10 micrometers, preferably between about 1-3 micrometers. The optional polymeric binder material preferably is substantially soluble in the vehicle although latexes may also be used. Preferred water soluble binders include polyvinyl alcohol, hydroxy ethyl-cellulose, methylcellulose, methyl-hydroxypropylcellulose, starch, modified starches, gelatin and the like. Suitable latex materials include polyacrylates, sytrene-butadiene-rubber latexes, polyvinylacetates, polystyrene, and the like. The polymeric binder is typically used to protect the coated materials from brushing, handling or other abrasive forces occasioned by storage and use of thermally responsive sheets and other record materials. Binder should be present in an amount to afford such protection and in an amount less than will interfere with achieving reactive contact between color-forming reactive materials, dye and developer.

Dry coating weights may, for example, be about 3 to about 9 grams per square meter (gsm) and preferably about 5 to about 6 gsm. The amount of thermally responsive composition is controlled by economic considerations, functional parameters and desired handling characteristics of the coated sheets.

The disclosed developer which is part of the disclosed thermally responsive composition or components thereof may be applied to a substrate or support either prior to, or after, the substrate or support is formed into an article (such as, for example, a paper product or a portion thereof). Paper products may include, for example, cash register or credit card receipts, flyers, magazines, tickets, mailing envelopes, newspapers, airplane boarding passes, luggage tags, baggage destination tags, and bus, train and lottery tickets and the like.

The disclosed composition may be applied using a variety of methods including spraying, brushing, roller coating, flood coating and dipping. The applied coating is then typically allowed to air dry or the drying is accelerated using drying devices, such as an oven, or any other method that provides an elevated temperature suitable for drying the coating.

The invention is further illustrated in the following non-limiting examples, in which all parts and percentage are by weight unless otherwise indicated.

EXAMPLES

Example 1

Liquid dispersions of a dye and a developer may be prepared separately by dispersing the ingredients listed in Table 3 using a sand mill.

TABLE 3

| | Weight (parts) |
|---|---|
| Developer Dispersion | |
| Developer- | |
| 4,4'Butylidenebis(2-t-butyl-5-methylphenol) | 20.0 |
| 10% aqueous polyvinyl alcohol solution | 5.0 |
| Water | 75.0 |
| Dye Dispersion | |
| Crystal Violet Lactone | 20.0 |
| 10% aqueous polyvinyl alcohol solution | 5.0 |
| Water | 75.0 |

Thermal paper may be prepared by depositing the thermally responsive coating composition (e.g. a mixture of equal weights of the dye dispersion and developer dispersion) onto a paper stock. Deposition of the coatings onto the paper may be for example, be carried out using bar coating, roll coating or reverse roll coating techniques. The coated paper may then be dried to obtain a thermally responsive record material.

Comparison Examples A& B and Examples 2-9

Using the method of Example 1, additional thermally responsive record materials may be prepared by replacing the developer in Example 1 with developers shown in Table 4.

TABLE 4

| Examples | Ingredients | Parts |
|---|---|---|
| Comparison Example A | Bisphenol A | 20.0 |
| Comparison Example B | Bisphenol S | 20.0 |
| Example 2 | 4,4'-(propane-2,2-diyl)bis(2,6-dimethylphenol) | 20.0 |
| Example 3 | 4,4'-methylenebis(2,6-dimethylphenol) | 20.0 |
| Example 4 | 4,4'-(ethane-1,2-diyl)bis(2,6-dimethylphenol) | 20.0 |
| Example 5 | 4,4'-butylidenebis(2-t-butyl-5-methylphenol) | 20.0 |
| Example 6 | 4,4'-methylenebis(2,6-di-t-butylphenol) | 20.0 |
| Example 7 | 2,2'-methylenebis(4-methyl-6-t-butylphenol | 20.0 |
| Example 8 | 4,4'-(ethane-1,2-diyl)bis(2,6-dimethylphenol) | 20.0 |
| Example 9 | bis-(3,5-dimethyl-4-hydroxyphenyl)-methane | 20.0 |
| Example 10 | 2,5-di-t-butylhydroquinone | 20.0 |
| Example 11 | Tetrabromobisphenol A | 20.0 |

The resulting thermally responsive record materials may be evaluated for image quality, smoothness and other properties. The disclosed polyhydric phenols may serve as desirable substitutes for BPA developers in thermally responsive record materials.

All patents, patent applications and literature cited in the specification are hereby incorporated by reference in their entirety. In the case of any inconsistencies, the present disclosure, including any definitions therein will prevail.

What is claimed is:

1. A thermally responsive composition comprising a dye and a developer dispersed in a liquid carrier, the developer comprising:

(i) a polyhydric phenol having two aryl or heteroaryl groups joined through a methylene group and in which each aryl or heteroaryl group includes a hydroxyl group attached to the ring and substituent groups attached to the ring at each ortho position relative to the hydroxyl group; and wherein the composition is substantially free of diphenols having estrogenic activity greater than or equal to that of bisphenol S.

2. The thermally responsive composition of claim 1, wherein each aryl or heteroaryl group includes two methyl substituent groups attached to the ring at ortho positions relative to the hydroxyl group.

3. The thermally responsive composition of claim 1, wherein the polyhydric phenol has Formula (I):

Formula (I)

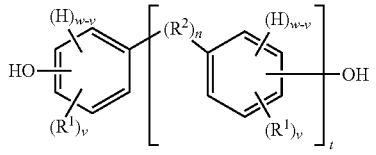

wherein:

H denotes a hydrogen atom, if present;

each $R^1$ is independently an atom or substituent group having an atomic weight of at least 15 Daltons and $R_1$ substituent groups are attached to the phenylene ring at each ortho position relative to the hydroxyl group;

v is independently 1 to 4;

w is 4;

$R^2$, is a divalent methylene group;

n is 1;

t is 1; and the composition is substantially free of polyhydric phenols having estrogenic agonist activity greater than or equal to that of bisphenol S.

4. The thermally responsive composition of claim 3, wherein each of the phenylene groups depicted in Formula (I) includes at least one $R^1$ methyl group attached to the phenylene ring at an ortho position relative to the hydroxyl group.

5. The thermally responsive composition of claim 4, wherein $R^1$ methyl groups are attached to the phenylene ring at both ortho positions relative to the hydroxyl group.

6. The thermally responsive composition of claim 3, wherein an $R^1$ group independently comprises an ethyl group.

7. The thermally responsive composition of claim 3, wherein each $R^1$ group is free of halogen atoms.

8. The thermally responsive composition of claim 3 wherein:

the hydroxyl group of each phenylene group depicted in Formula (I) is located at a para position relative to $R^2$.

9. The thermally responsive composition of claim 3 wherein:

the $R^1$ groups include 1 to 4 carbon atoms.

10. The thermally responsive composition of claim 3 wherein:

the $R^1$ groups comprise linear butyl, isobutyl or tert-butyl groups.

11. The thermally responsive composition of claim 3, wherein the polyhydric phenol of Formula (I) is 4,4'-methylenebis(2,6-di-t-butylphenol), 4,4'-methylenebis(2,6-dimethylphenol), or a derivative or combination thereof.

12. The thermally responsive composition of claim 1, wherein the dye is a black, blue or red dye.

13. A thermally responsive record material, comprising:

a substrate; and a thermally responsive composition of claim 1 disposed on at least a portion of the substrate.

14. The thermally responsive composition of claim 1, wherein the developer is a polyhydric phenol or derivative thereof that exhibits a log Relative Proliferative Effect value in an MCF-7 cell proliferation assay less than that of bisphenol S.

15. A method for making a thermal responsive record material comprising:

(a) providing a substrate;

(b) applying a thermally responsive composition onto the substrate;

wherein the thermally responsive composition comprises:

a dye and a developer dispersed in a liquid carrier, the developer comprising a polyhydric phenol shown in Formula (I):

Formula (I)

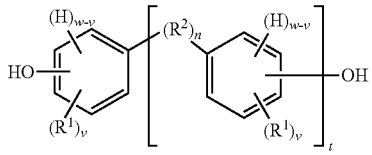

wherein:

H denotes a hydrogen atom, if present;

each $R^1$ is independently an atom or group having an atomic weight of at least 15 Daltons attached to the phenylene ring at each ortho position relative to the hydroxyl group;

v is independently 1 to 4;

w is 4;

$R^2$ is a divalent methylene group;

n is 1;

t is 1; and the thermally responsive record material is substantially free of polyhydric phenols having estrogenic agonist activity greater than or equal to that of bisphenol S.

16. The method of claim 15, wherein the substrate is paper.

17. The method of claim 15, wherein the record material comprises a cash register receipt, credit card receipt, flyer, magazine, ticket, mailing envelope, newspaper, airplane boarding pass, luggage tag, baggage destination tag, bus ticket, train ticket or lottery ticket.

* * * * *